US011039688B2

(12) United States Patent
Pecar et al.

(10) Patent No.: US 11,039,688 B2
(45) Date of Patent: Jun. 22, 2021

(54) DAMPER ASSEMBLIES

(71) Applicant: Titus International Limited, Middlesex (GB)

(72) Inventors: David Pecar, Koper (SI); Valter Svara, Izola (SI); Danijel Kozlovic, Dekani (SI)

(73) Assignee: Titus International Limited, Middlesex (GB)

( * ) Notice: Subject to any disclaimer, the term of this patent is extended or adjusted under 35 U.S.C. 154(b) by 0 days.

(21) Appl. No.: 14/360,089

(22) PCT Filed: Nov. 22, 2012

(86) PCT No.: PCT/GB2012/052898
§ 371 (c)(1),
(2) Date: May 22, 2014

(87) PCT Pub. No.: WO2013/076495
PCT Pub. Date: May 30, 2013

(65) Prior Publication Data

US 2014/0294328 A1 Oct. 2, 2014

(30) Foreign Application Priority Data

Nov. 22, 2011 (GB) ..... 1120179

(51) Int. Cl.
*A47B 88/467* (2017.01)
*A47B 88/473* (2017.01)
(Continued)

(52) U.S. Cl.
CPC ..... *A47B 88/467* (2017.01); *A47B 88/40* (2017.01); *A47B 88/473* (2017.01); *A47B 88/423* (2017.01)

(58) Field of Classification Search
CPC ..... A47B 88/047; A47B 88/40; A47B 88/473; A47B 88/423; A47B 88/467; E05F 5/027
See application file for complete search history.

(56) References Cited

U.S. PATENT DOCUMENTS 5,011,242 A * 4/1991 Cosme ..... A47B 88/044 312/334.36
5,207,781 A * 5/1993 Rock ..... E05B 65/46 312/319.1

(Continued)

FOREIGN PATENT DOCUMENTS

AT 509064 A4 6/2011
JP 2013138825 A * 7/2013 ..... A47B 88/467

*Primary Examiner* — Hanh V Tran
(74) *Attorney, Agent, or Firm* — Alan D. Kamrath; Karin L. Williams; Mayer & Williams PC

(57) ABSTRACT

A device controls closing movement of a drawer in a drawer cabinet. The device includes an actuator driven by a spring for imparting a biassing force to the drawer as it closes. The actuator is mounted on a housing, which is itself mounted on the cabinet, and is movable back and forth in the direction of movement of the drawer. A damper is mounted on the housing and is operable on the actuator to impart a damping force on it in a sense to resist the closing movement of the drawer. The actuator is triggered by a catch mounted on the drawer. The housing and catch are mountable without need of pre-drilling and include locating members for determining their relative positions on the cabinet and drawer respectively.

17 Claims, 3 Drawing Sheets

(51) Int. Cl.
*A47B 88/40* (2017.01)
*A47B 88/423* (2017.01)

(56) References Cited

U.S. PATENT DOCUMENTS 7,677,854 B2 * 3/2010 Langewiesche ..... F16B 25/00 411/386
8,632,141 B2 * 1/2014 Park ..... A47B 88/493 312/333
8,770,683 B2 * 7/2014 Rehage ..... A47B 88/467 312/319.1
8,905,498 B2 * 12/2014 Hammerle ..... A47B 88/40 312/333
8,911,039 B2 * 12/2014 Radusin ..... A47B 88/467 312/333
9,107,500 B2 * 8/2015 Zimmermann ..... A47B 88/463
2004/0056572 A1 * 3/2004 Chen ..... A47B 88/473 312/333
2004/0056573 A1 * 3/2004 Chae ..... F25D 25/025 312/404
2006/0279186 A1 * 12/2006 Lam ..... A47B 88/467 312/319.1
2007/0046158 A1 * 3/2007 Hoffman ..... A47B 88/467 312/333
2007/0278919 A1 * 12/2007 Lu ..... A47B 88/467 312/333
2008/0231156 A1 * 9/2008 Hoshide ..... A47B 88/467 312/334.46
2009/0195131 A1 * 8/2009 Chi ..... A47B 88/493 312/319.1
2009/0273129 A1 * 11/2009 Zimmer ..... E05F 5/003 267/170
2010/0123378 A1 5/2010 Chen et al.
2010/0219727 A1 * 9/2010 Aguilar Ante ..... A47B 88/40 312/319.1
2010/0231107 A1 * 9/2010 Radusin ..... A47B 88/467 312/319.1
2011/0037362 A1 * 2/2011 Park ..... A47B 88/467 312/319.1
2011/0041284 A1 * 2/2011 Kimura ..... E05F 5/003 16/49
2011/0095670 A1 * 4/2011 Cho ..... F25D 25/025 312/405.1
2011/0115353 A1 5/2011 Domenig et al.
2011/0175508 A1 * 7/2011 Rechberg et al. ..... 312/334.8
2012/0288221 A1 11/2012 Jahrling et al.

* cited by examiner

DAMPER ASSEMBLIES

This invention relates to damper assemblies and, in particular, though not exclusively, to damper assemblies for use in furniture.

The invention provides a device for controlling movement of a first member relative to a second member, e.g. in a piece of furniture, with said device comprising an actuator for imparting a biassing force to said first member in a first direction, a housing mountable on said second member for mounting said actuator for reciprocable movement in and opposite to said first direction, damper means operable on the actuator to impart a damping force thereto in a sense to resist its movement in said first direction, and a catch mountable on the first member for releasably engaging the actuator. The housing and catch comprise locating means for determining their relative positions on their respective members.

Figure 2:
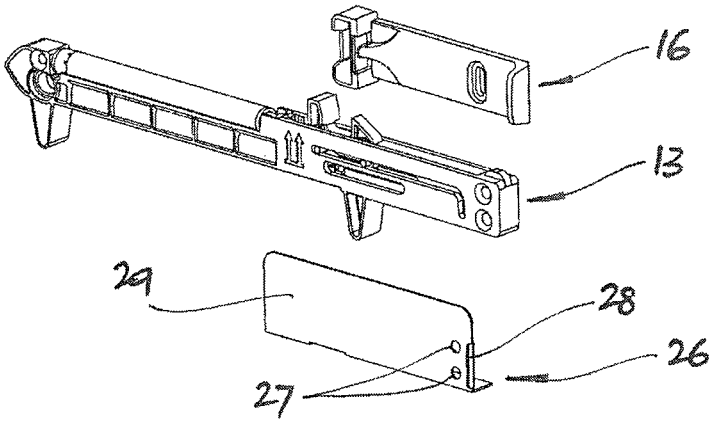
Figure 1:
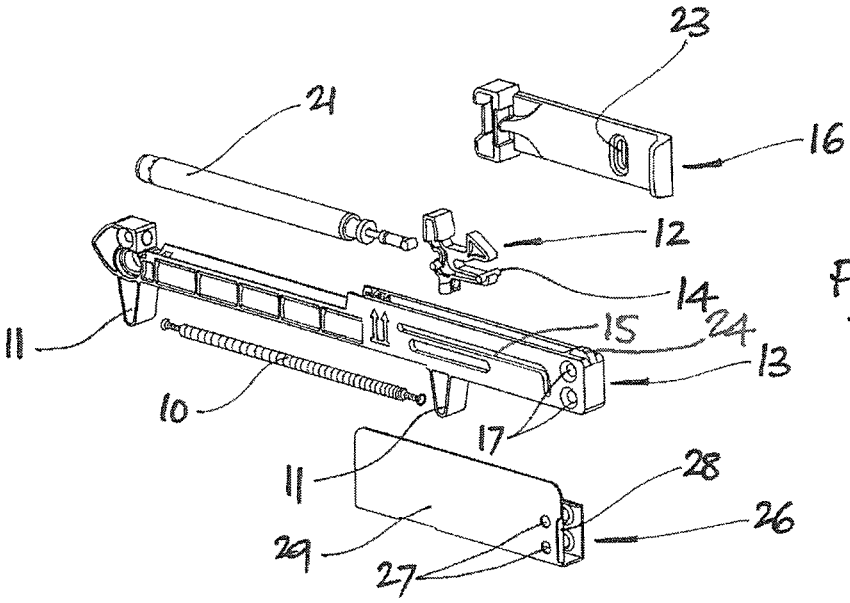
Figure 3:
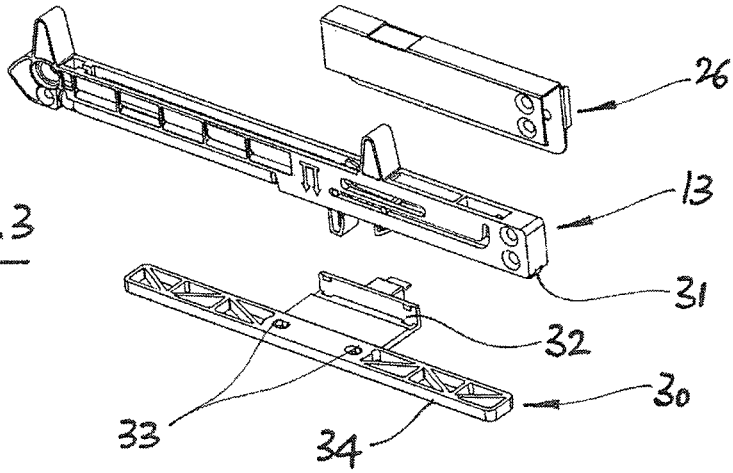
Figure 4:
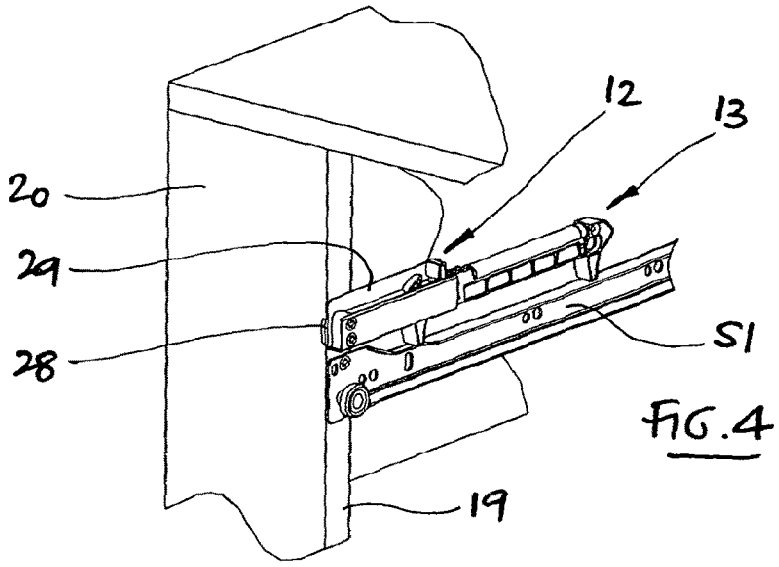
Figure 5:
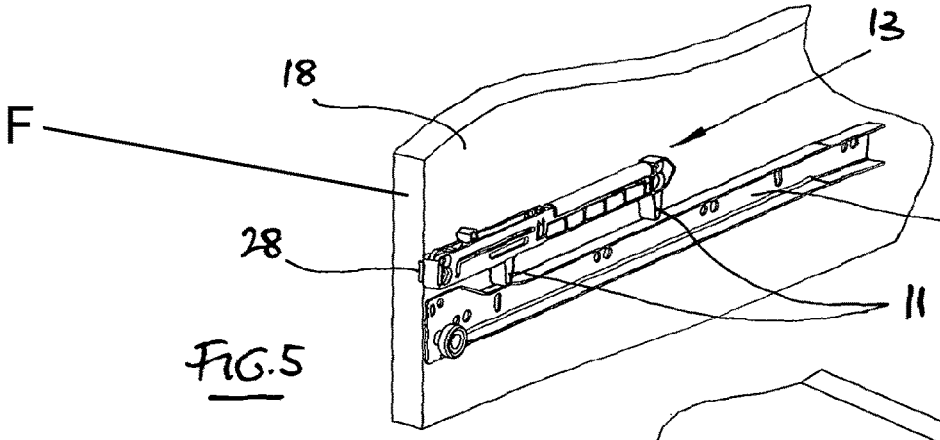
Figure 6:
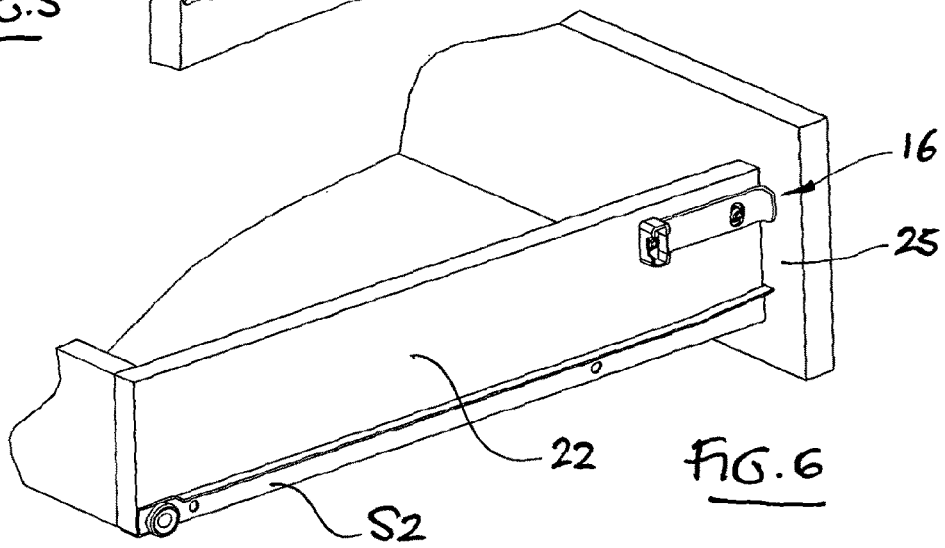
Figure 7:
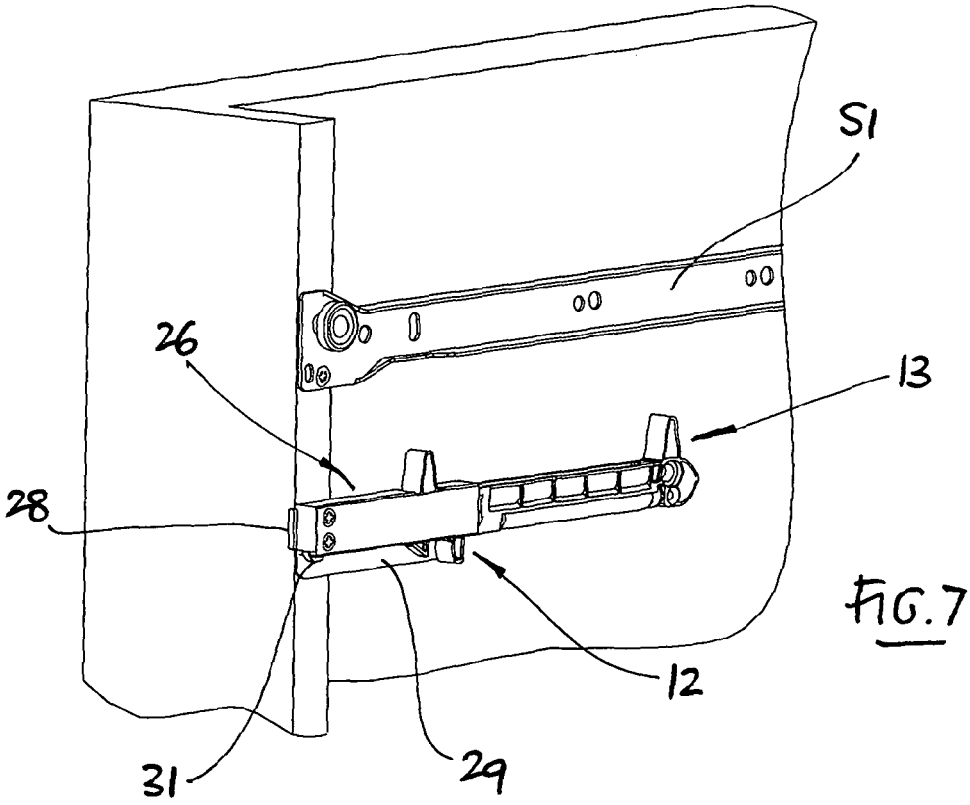
Figure 8:
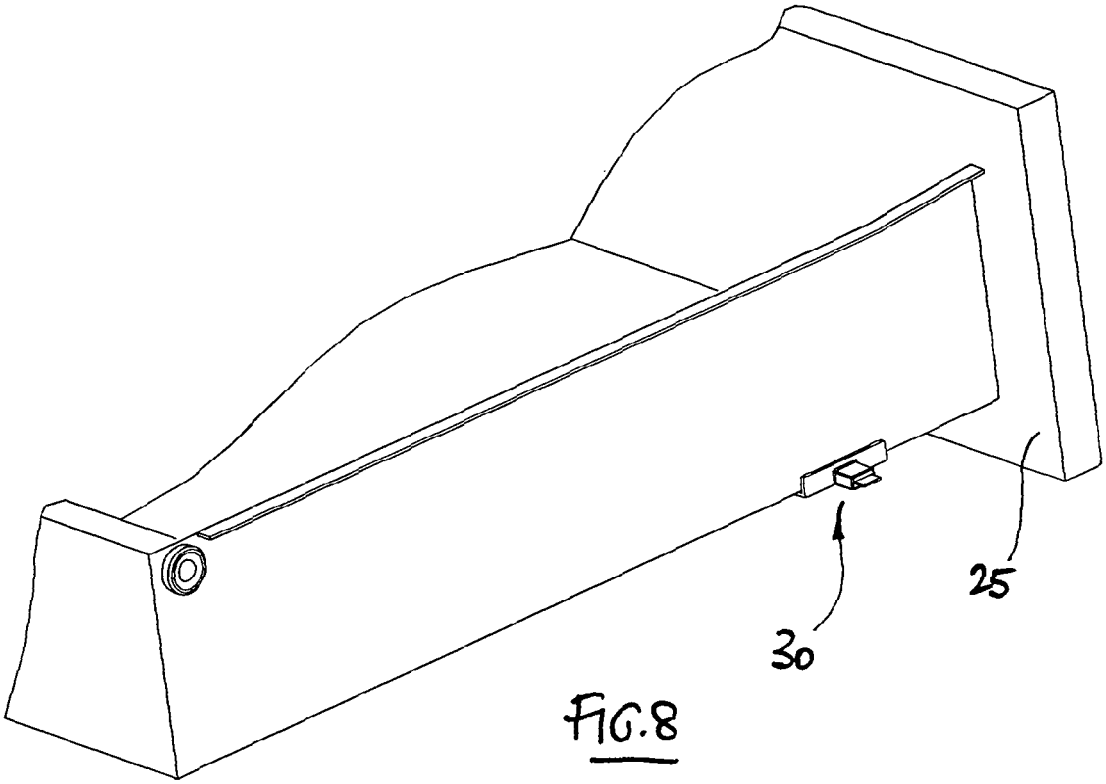

By way of example, embodiments of the invention will now be described with reference to the accompanying drawings, in which:

FIG. 1 illustrates a first embodiment of a damper assembly according to the invention, FIG. 2 illustrates a second embodiment of a damper assembly according to the invention, FIG. 3 illustrates a third embodiment of a damper assembly according to the invention, FIG. 4 shows the damper assembly of FIG. 1 in use on a first form of drawer cabinet, FIG. 5 shows the damper assembly of FIG. 2 in use on a second form of drawer cabinet, FIG. 6 shows a drawer for the drawer cabinet of FIG. 4 or 5, FIG. 7 shows the damper assembly of FIG. 1 in use on a third form of drawer cabinet, and FIG. 8 shows a drawer for the drawer cabinet of FIG. 7, The form of damper assembly illustrated in FIG. 1 is designed to impart a damped force to the closing movement of a drawer in a drawer cabinet. A tension spring 10 provides the force, and a linear piston and cylinder damper 21 provides the damping. The spring 10 and damper 21 are both connected to an actuator 12, which is movably mounted in a housing 13 attached to the side wall or frame of the cabinet. The housing 13 is conveniently made of moulded plastics material. Movement of the actuator 12 is guided by a set of pins 14 engaging in tracks 15 in the housing 13.

The actuator 12 can be set in a first end position where the extension spring 10 is loaded and the damper 21 is extended. The actuator 12 can be moved out of this position, upon which it will be pulled back to its other end position under the biassing action of the tension spring 10 and against the damping action provided by compression of the damper 21.

The initial movement of the actuator 12 out of its first end position is triggered by its engagement with a catch 16 attached to the drawer. The housing 13 and catch 16 are positioned so that the catch will engage the actuator 12 during the closing movement of the drawer, with the actuator thereby imparting a damped force to assist its closure. The catch 16 and actuator 12 interact during the opening movement of the drawer to re-set the actuator in its first end position. During this movement, no damping action is provided by the damper 21.

Drawer return mechanisms of this general nature are known in the art, and it is often the case that cabinets and drawers will be pre-drilled with a standard pattern of holes to assist with their mounting. This is not always the case, however, and in any event, it is helpful if this pre-drilling step is not required.

The housing 13 here is able to be attached to a cabinet by means which do not require pre-drilling, e.g. by using self-tapping screws, which are applied via holes 17 in the housing. The housing 13 is attachable in this manner either directly to the inner wall 18 of the cabinet, which will typically be made of wood or the like (as illustrated in FIG. 5) or, where the cabinet includes framework, to the inner edge 19 of the frame 20, which will again typically be made of wood or the like (as illustrated in FIG. 4).

The catch 16 is also able to be attached to the drawer without need of pre-drilling, e.g. again by using self-tapping screws, which are applied via a hole 23. The hole 23 is conveniently elongate to allow for a degree of adjustment.

It is essential that the housing 13 and catch 16 are located in the right positions in their attachment to their respective members, so that the catch will act on the actuator 12 during movement of the drawer. To this end, the housing 13 has a pair of legs 11 extending therefrom. As seen in FIGS. 4 and 5, the legs 11 are designed to sit on the drawer slide rail S1, which acts as a datum reference and thereby determines the vertical position of the housing 13 relative to the cabinet.

The position of the housing 13 in the direction of drawer movement, ie its horizontal location, is determined by a locating flange 28 on the front edge of the housing. As will be seen in FIG. 5, the locating flange 28 is designed to abut the front edge of the innerwall 18 of the cabinet.

It will be noted that it may be possible to locate the housing 13 in its correct vertical position simply by means of the locating flange 28 and one of the legs 11, in which case, the housing would not need a pair of legs, but only one.

Where the cabinet has a framework, a bracket 26 is provided to help mount the housing 13. The bracket 26 is conveniently formed from sheet metal and may be of L-shaped cross-section (as seen in FIG. 2) or U-shaped cross-section (as seen in FIG. 1). In both cases, the bracket 26 is designed to partially envelop the housing 13 at the point where it attaches to the cabinet. For this purpose, the bracket 26 comprises holes 27 to match the holes 17 in the housing. In this case, the locating flange 28 may be provided on the bracket 26 instead of on the housing 13. As will be seen in FIG. 4, the locating flange 28 is designed to abut the front face or edge F of the cabinet frame 20.

Because of its material and cross-section, the bracket 26 lends rigidity to the mounting of the housing 13 in the case where the cabinet has a framework (as seen in FIG. 4) and the housing is not otherwise laterally supported. In addition, it will be seen that the rear flange 29 of the bracket 26 is designed to extend above the level of the housing 13. Where the housing 13 is to be attached to a cabinet with a framework (as seen in FIG. 4), the extension piece of the rear flange 29 effectively provides the actuator 12 with a lateral support surface. In use, when the catch 16 strikes the actuator 12 as the drawer closes, the rear flange 29 of the bracket 26 helps to prevent the actuator and/or housing from being knocked sideways out of engagement with the catch.

The vertical location of the catch 16, i.e. its position above the drawer slide rail S2, is determined by setting it against a land 24 on the housing 13, which acts as a datum reference. The horizontal location of the catch 16 is determined by its abutment with a rear edge 25 of a drawer shown as the inner surface of the drawer front. in FIG. 6, the catch 16 is seen in position on a side panel 22 of a drawer, which in this case is made of panels of wood or the like.

The form of damper assembly seen in FIG. 3 is essentially the same as the FIGS. 1 and 2 assemblies in terms of the housing and bracket configurations, but is for use in cabinets that have drawers with metal side panels. The main difference is in the configuration of the catch 30, which in this case is designed to be attached to the underside of the drawer, rather than the side panel, as seen in FIG. 8 (the underside being a panel of wood or the like and the side panel being of metal). The means of attachment again does not require pre-drilling, e.g. by using self-tapping screws, which are inserted via holes 33 in the catch 30.

Here, the catch 30 has a flange 32 to engage the side of the drawer and thus locate its lateral position. Its position in the direction of drawer movement is determined by the abutment of one end of its elongated mounting foot 34 with the inner surface of the drawer front 25.

The other difference is that the housing 13 in this case is designed to be attached to the cabinet in an inverted orientation and below rather than above the slide rail S1, as will be seen in FIG. 7. Here, the precise vertical location of the housing 13 is determined by setting the catch 30 against a land 31 on the housing, which acts as a datum reference as the drawer is closed. This will ensure that the housing 13 is at the right level for the catch 30 to strike and engage the actuator 12 during movement of the drawer. The horizontal location of the housing 13 is determined by the abutment on the front face of the cabinet of the locating flange 28, which may be provided either on the housing itself or on the bracket 26.

The housing 13 is mounted to the cabinet via the bracket 26, which helps to give the housing additional support and rigidity. In addition, the extension piece of the rear flange 29 again provides lateral support for the actuator 12 in use.

The damper assemblies described above have been designed for use in drawer cabinets. However, it will be appreciated that the technology can easily be adapted for use in other furniture applications and indeed, in other quite different applications, such as vehicles or buildings.

The invention claimed is:

1. A combination comprising: a first member having a rear edge; a second member having a front edge; a slide assembly moveably mounting the first member relative to the second member for movement in a direction of movement, with the rear and front edges being perpendicular to the direction of movement, with said slide assembly extending parallel to the direction of movement; an actuator; a housing mounted on said second member and mounting said actuator for reciprocable movement in the direction of movement, with the actuator biased in a first direction parallel to the direction of movement; means for imparting a damping force to resist movement of the actuator in said first direction; and a catch mountable on the first member parallel to and spaced from the slide assembly for releasably engaging the actuator, wherein the catch includes means for positionally locating the catch to extend from the rear edge of the first member parallel to the direction of movement, and wherein the housing comprises means for positionally locating the housing to extend from the front edge of said second member parallel to the direction of movement;

wherein the means for positionally locating the housing comprises means for positioning the housing by engaging the slide assembly and abutting the front edge of the second member;

wherein the means for positionally locating the catch comprises means for positioning the catch by setting against the housing and abutting against the rear edge of the first member with the housing located intermediate the catch and the slide assembly; and further comprising a bracket for partially enveloping the housing and assisting with the mounting of the housing on the second member, with the bracket separable from the slide assembly and the housing.

2. A combination as claimed in claim 1 wherein the means for positionally locating the housing comprises a pair of contact points on the housing to removeably engage the slide assembly.

3. A combination as claimed in claim 2 wherein the pair of contact points comprises a pair of legs extending from the housing and providing said pair of contact points engaging the slide assembly.

4. A combination as claimed in claim 3 further comprising a land on the housing engageable by the catch for assisting with positionally locating the catch.

5. A combination as claimed in claim 1 wherein the bracket includes a lip, wherein the lip extends away from the housing perpendicular to the direction of movement and abuts the front edge of the second member to positionally locate the housing relative to said direction of movement.

6. A combination as claimed in claim 5 wherein the bracket includes a portion that provides lateral support for the actuator in engagement of the actuator with the catch.

7. A combination as claimed in claim 6 wherein the bracket has a generally L-shaped cross-section.

8. A combination as claimed in claim 6 wherein the bracket has a generally U-shaped cross-section.

9. A combination as claimed in claim 1 wherein the housing and the catch are attached to the first and second members by self-tapping screws.

10. A combination as claimed in claim 9 wherein the housing and catch are mounted on the first and second members without pre-drilled holes for the self-tapping screws.

11. A combination as claimed in claim 1 further comprising a tension spring biasing the actuator in the first direction.

12. A combination as claimed in claim 1 wherein the means for imparting the damping force comprises a linear piston and cylinder damper.

13. A combination as claimed in claim 1 further comprising a land on the housing engageable by the catch for assisting with positionally locating the catch.

14. A combination as claimed in claim 1 wherein the bracket includes a portion providing lateral support for the actuator in engagement of the actuator with the catch.

15. A combination as claimed in claim 14 wherein the bracket has a generally L-shaped cross-section.

16. A combination as claimed in claim 14 wherein the bracket has a generally U-shaped cross-section.

17. A combination comprising: a first member having a rear edge; a second member having a front edge; a slide assembly moveably mounting the first member relative to the second member for movement in a direction of movement, with the rear and front edges being perpendicular to the direction of movement, with said slide assembly extending parallel to the direction of movement; an actuator; a housing mounted on said second member and mounting said actuator for reciprocable movement in the direction of movement, with the actuator biased in a first direction parallel to the direction of movement; means for imparting a damping force to resist movement of the actuator in said first direction; and a catch mountable on the first member parallel to and spaced from the slide assembly for releasably engaging the actuator, wherein the catch includes means for positionally locating the catch to extend from the rear edge of the first member parallel to the direction of movement, and wherein the housing comprises means for positionally locating the housing to extend from the front edge of said second member parallel to the direction of movement;

wherein the means for positionally locating the housing comprises a pair of contact points on the housing to removeably engage the slide assembly, wherein the pair of contact points comprises a pair of legs extending from the housing and providing said pair of contact points engaging the slide assembly; and further comprising a land on the housing engageable by the catch for assisting with positionally locating the catch.

* * * * *